US007885579B2

(12) United States Patent
Watanabe et al.

(10) Patent No.: US 7,885,579 B2
(45) Date of Patent: Feb. 8, 2011

(54) CHARGING DEVICE, IMAGE FORMING APPARATUS AND CHARGING METHOD

(75) Inventors: Takeshi Watanabe, Kanagawa-ken (JP); Masashi Takahashi, Kanagawa-ken (JP); Mitsuaki Kouyama, Tokyo (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 1027 days.

(21) Appl. No.: 11/557,549

(22) Filed: Nov. 8, 2006

(65) Prior Publication Data

US 2008/0107450 A1 May 8, 2008

(51) Int. Cl.
*G03G 15/02* (2006.01)

(52) U.S. Cl. ..... 399/175; 399/168; 399/174; 399/176

(58) Field of Classification Search ..... 399/168, 399/174–176

See application file for complete search history.

(56) References Cited

U.S. PATENT DOCUMENTS

| | | | | |
|---|---|---|---|---|
| 5,842,087 | A * | 11/1998 | Matsushita et al. | 399/174 |
| 2003/0049050 | A1 * | 3/2003 | Shakuto et al. | 399/159 |
| 2007/0072108 | A1 * | 3/2007 | Kumar et al. | 430/111.31 |
| 2007/0274738 | A1 | 11/2007 | Watanabe et al. | |
| 2008/0124130 | A1 | 5/2008 | Watanabe et al. | |
| 2008/0166154 | A1 | 7/2008 | Watanabe et al. | |

FOREIGN PATENT DOCUMENTS

| | | | |
|---|---|---|---|
| JP | 08-339113 | | 12/1996 |
| JP | 2000147869 A | * | 5/2000 |
| JP | 2001-051480 | | 2/2001 |
| JP | 2002-351195 | | 12/2002 |
| JP | 2004-279883 | | 10/2004 |
| JP | 2005-173566 | | 6/2005 |

OTHER PUBLICATIONS

English Translation of JP 2000147869 to Amamiya et al.*

* cited by examiner

*Primary Examiner*—Ryan D Walsh
(74) *Attorney, Agent, or Firm*—Turocy & Watson, LLP

(57) ABSTRACT

There is provided a charging technique in which the generation of ozone is suppressed and charging efficiency can be improved. A charging device includes a contact unit configured to include a magnetic brush coming in contact with a body to be charged, the contact unit including, as a magnetic particle forming the magnetic brush, the magnetic particle containing at least a particle having a negative electronegativity, and a voltage application unit configured to negatively charge the body to be charged by applying a specified bias voltage through the magnetic brush in the contact unit to the body to be charged.

16 Claims, 6 Drawing Sheets

FIG. 2

| TEST No. | SAMPLE | | CLUSTER DIAMETER OF DIAMOND PARTICLE (ACTUALLY MEASURED) | RESISTANCE VALUE OF MAGNETIC PARTICLE (Ω cm) | PHOTO-CONDUCTOR | APPLIED BIAS | IMAGE STATE | | | | | | | |
|---|---|---|---|---|---|---|---|---|---|---|---|---|---|---|
| | | | | | | | INITIAL | AFTER 10,000 SHEETS | AFTER 20,000 SHEETS | AFTER 30,000 SHEETS | AFTER 40,000 SHEETS | AFTER 50,000 SHEETS | AFTER 60,000 SHEETS | AFTER 70,000 SHEETS |
| 1 | 1 | CONVENTIONAL EXAMPLE | | 5×10e4 | A | D | ○ | b | | | | | | |
| 2 | 2 | | | 5×10e5 | A | C | a2 | | | | | | | |
| 3 | | | | | A | D | ○ | ○ | b | | | | | |
| 4 | | | | | B | D | a3 | | | | | | | |
| 5 | 3 | | | 5×10e6 | A | C | a2 | | | | | | | |
| 6 | | | | | A | D | ○ | ○ | ○ | ○ | ○ | a1 | a1 | a1 |
| 7 | | | | | B | D | a3 | | | | | | | |
| 8 | 4 | | | 5×10e7 | A | C | a2 | | | | | | | |
| 9 | | | | | A | D | ○ | ○ | ○ | ○ | a1 | a1 | | |
| 10 | | | | | B | D | a3 | | | | | | | |
| 11 | 5 | DIAMOND FINE PARTICLE DISPERSION | 3 | 5×10e6 | A | C | ○ | ○ | ○ | | ○ | ○ | ○ | ○ |
| 12 | | | | | A | D | ○ | ○ | ○ | ○ | ○ | ○ | ○ | ○ |
| 13 | | | | | B | C | a1 | a1 | a1 | a1 | a1 | a1 | a1 | a1 |
| 14 | | | | | B | D | ○ | ○ | ○ | ○ | ○ | ○ | ○ | ○ |
| 15 | 6 | | 100 | 6×10e6 | A | C | ○ | ○ | ○ | ○ | ○ | ○ | ○ | ○ |
| 16 | | | | | A | D | ○ | ○ | ○ | ○ | ○ | ○ | ○ | ○ |
| 17 | | | | | B | C | a1 | a1 | a1 | a1 | a1 | a1 | a1 | a1 |
| 18 | | | | | B | D | ○ | ○ | ○ | ○ | ○ | ○ | ○ | ○ |
| 19 | 7 | | 250 | 6×10e6 | B | C | a1 | a1 | a1 | a1 | a1 | a1 | a1 | a1 |
| 20 | 8 | | 2000 | 4×10e6 | B | C | a1 | a1 | a1 | a1 | a1 | a1 | a1 | a1 |
| 21 | 9 | | 30000 | 5×10e6 | A | C | ○ | ○ | ○ | ○ | ○ | ○ | ○ | ○ |
| 22 | | | | | A | D | ○ | ○ | ○ | ○ | ○ | ○ | ○ | ○ |
| 23 | | | | | B | C | a1 | a1 | a1 | a1 | a1 | | | |
| 24 | | | | | B | D | ○ | ○ | ○ | ○ | ○ | ○ | ○ | ○ |

FIG. 3

| TEST No. | SAMPLE | | CLUSTER DIAMETER OF DIAMOND PARTICLE (ACTUALLY MEASURED) | RESISTANCE VALUE OF MAGNETIC PARTICLE (Ω cm) | PHOTO-CONDUCTOR | APPLIED BIAS | IMAGE STATE | | | | | | | |
|---|---|---|---|---|---|---|---|---|---|---|---|---|---|---|
| | | | | | | | INITIAL | AFTER 10,000 SHEETS | AFTER 20,000 SHEETS | AFTER 30,000 SHEETS | AFTER 40,000 SHEETS | AFTER 50,000 SHEETS | AFTER 60,000 SHEETS | AFTER 70,000 SHEETS |
| 25 | 10 | DIAMOND FINE PARTICLE DISPERSION | 50000 | 6×10e6 | A | C | ○ | ○ | ○ | ○ | ○ | ○ | ○ | ○ |
| 26 | | | | | A | D | ○ | ○ | ○ | ○ | ○ | ○ | ○ | ○ |
| 27 | | | | | B | C | a2 | | | | | | | |
| 28 | | | | | B | D | a1 | a1 | a1 | a1 | a1 | a1 | a1 | a1 |
| 29 | 11 | | 100 | 5×10e5 | A | C | ○ | ○ | ○ | ○ | ○ | ○ | ○ | ○ |
| 30 | | | | | A | D | ○ | ○ | ○ | ○ | ○ | ○ | ○ | ○ |
| 31 | | | | | B | C | a1 | a1 | a1 | a1 | a1 | a1 | a1 | a1 |
| 32 | | | | | B | D | ○ | ○ | ○ | ○ | ○ | ○ | ○ | ○ |
| 33 | 12 | | 100 | 5×10e4 | A | C | ○ | ○ | ○ | ○ | ○ | ○ | ○ | ○ |
| 34 | | | | | A | D | ○ | ○ | ○ | ○ | b | | | |
| 35 | | | | | B | C | a1 | a1 | a1 | a1 | a1 | a1 | a1 | a1 |
| 36 | | | | | B | D | ○ | ○ | ○ | ○ | b | | | |
| 37 | 13 | CARBON NANOTUBE DISPERSION | | 5×10e6 | A | C | ○ | ○ | ○ | ○ | ○ | ○ | ○ | ○ |
| 38 | | | | | A | D | ○ | ○ | ○ | ○ | ○ | ○ | ○ | ○ |
| 39 | | | | | B | C | a2 | | | | | | | |
| 40 | | | | | B | D | a1 | a1 | a1 | a1 | a1 | a1 | a2 | |
| 41 | 14 | | | 5×10e5 | A | C | ○ | ○ | ○ | ○ | ○ | ○ | ○ | ○ |
| 42 | | | | | A | D | ○ | ○ | ○ | ○ | ○ | ○ | ○ | ○ |
| 43 | | | | | B | C | a2 | | | | | | | |
| 44 | | | | | B | D | a1 | a1 | a1 | a1 | a1 | a1 | b | |
| 45 | 15 | | | 5×10e4 | A | C | ○ | ○ | ○ | ○ | b | | | |
| 46 | | | | | A | D | ○ | ○ | b | | | | | |
| 47 | | | | | B | C | a2 | | | | | | | |
| 48 | | | | | B | D | a1 | a1 | b | | | | | |

FIG. 5

| TEST No. | SAMPLE | | CLUSTER DIAMETER OF DIAMOND PARTICLE (ACTUALLY MEASURED) | RESISTANCE VALUE OF MAGNETIC PARTICLE (Ωcm) | PHOTO-CONDUCTOR | APPLIED BIAS | IMAGE STATE | | | | | | AMOUNT OF SHAVING OF PHOTO-CONDUCTIVE FILM AFTER 50,000 SHEETS |
|---|---|---|---|---|---|---|---|---|---|---|---|---|---|
| | | | | | | | INITIAL | AFTER 10,000 SHEETS | AFTER 20,000 SHEETS | AFTER 30,000 SHEETS | AFTER 40,000 SHEETS | AFTER 50,000 SHEETS | |
| 49 | 3 | CONVENTIONAL EXAMPLE | | 5×10e6 | A | D | ○ | a1&c1 | a2&c2 | | | | |
| 50 | 4 | | | 5×10e7 | A | D | ○ | a2&c1 | | | | | |
| 51 | 5 | DIAMOND FINE PARTICLE DISPERSION | 3 | 5×10e6 | A | C | ○ | ○ | ○ | ○ | ○ | a1 | |
| 52 | | | | | A | D | ○ | ○ | ○ | ○ | ○ | c1 | |
| 53 | | | | | B | C | a1 | a1 | a1 | a1 | a1 | a1 | |
| 54 | | | | | B | D | ○ | ○ | ○ | ○ | ○ | c1 | |
| 55 | 6 | | 100 | 6×10e6 | A | C | ○ | ○ | ○ | ○ | ○ | a1 | |
| 56 | | | | | A | D | ○ | ○ | ○ | ○ | ○ | c1 | |
| 57 | | | | | B | C | a1 | a1 | a1 | a1 | a1 | a1 | 1.0 μm |
| 58 | | | | | B | D | ○ | ○ | ○ | ○ | ○ | c1 | |
| 59 | 11 | | 100 | 5×10e5 | A | C | ○ | ○ | ○ | ○ | ○ | a1 | |
| 60 | | | | | A | D | ○ | ○ | ○ | ○ | ○ | c1 | |
| 61 | | | | | B | C | a1 | a1 | a1 | a1 | a1 | a1 | 1.1 μm |
| 62 | | | | | B | D | ○ | ○ | ○ | ○ | ○ | c1 | |
| 63 | 13 | CARBON NANOTUBE DISPERSION | | 5×10e6 | A | C | ○ | ○ | ○ | ○ | a1 | a1 | |
| 64 | | | | | A | D | ○ | ○ | ○ | ○ | ○ | a1&c1 | |
| 65 | 6 | DIAMOND FINE PARTICLE | 100 | 6×10e6 | a-Si | C | a1 | a1 | a1 | a1 | a1 | a1 | 0.1 μm |
| 66 | | | | | CHAIN POLYMERI-ZATION PHOTOC-ONDUCTOR | C | a1 | a1 | a1 | a1 | a1 | a1 | 0.2 μm |
| 17 | | | | | B | C | a1 | a1 | a1 | a1 | a1 | a1 | 2.2 μm |

CHARGING DEVICE, IMAGE FORMING APPARATUS AND CHARGING METHOD

BACKGROUND OF THE INVENTION

1. Field of the Invention

The present invention relates to a charging technique to charge a body to be charged, and particularly to a technique to contribute to the improvement of charging efficiency.

2. Description of the Related Art

Hitherto, as a charging system or a transfer system used for an image forming apparatus such as an electrophotographic apparatus, a corona charging device is often used mainly as a non-contact charging system. In addition to this, as a non-contact charging system with less ozone generation, there is known roller charging, brush charging, blade charging, magnetic brush charging, proximate charging to charge a charging device, such as a roller, through a gap of several μm to several hundred μm relative to a member to be charged, such as a photoconductor, or the like.

In the case where the roller charging or the proximate charging is used, although the amount of ozone generated from the used equipment can be reduced to a safety level, there is a problem that an electric discharge occurs at close distance from a photoconductor, high-density ozone is generated, and ion impact by an intense electric field is given to the photoconductor, and accordingly, the life of the photoconductor is remarkably shortened. This is a problem from the viewpoint of resource saving, and this is a problem that safety is not ensured.

On the other hand, in the magnetic brush charging device, a magnetic roller is used as a charging roller, a carrier particle as in general two-component magnetic brush development is attached to the charging roller by magnetic force to form a magnetic brush, and the magnetic brush is brought into contact with the surface of a body to be charged, such as a photoconductor, to charge it. At this time, the resistance of the carrier particle and the surface resistance at the photoconductor side are adjusted, so that the efficient charging becomes possible by an electric charge injection phenomenon without electric discharge, and the charging at low bias and without ozone generation becomes possible (see, for example, JP-A-8-339113, JP-A-2001-51480).

However, in the magnetic brush charging, as described above, in addition to the characteristics of the carrier, unless the resistance of the surface of the photoconductor is made low, satisfactory injection charging can not be performed, and accordingly, when a surface layer with low resistance or the like is used for the photoconductor, there have been disadvantages that when a high-definition image is tried to be formed, the image is blurred or becomes foggy.

SUMMARY OF THE INVENTION

The invention has an object to provide a charging technique in which the generation of ozone is suppressed and charging efficiency can be improved.

In order to solve the problem, according to an aspect of the invention, a charging device includes a contact unit configured to include a magnetic brush coming in contact with a body to be charged, the contact unit including, as a magnetic particle forming the magnetic brush, the magnetic particle containing at least a particle having a negative electronegativity, and a voltage application unit configured to negatively charge the body to be charged by applying a specified bias voltage through the magnetic brush in the contact unit to the body to be charged.

Besides, according to another aspect of the invention, a charging device includes contact means for including a magnetic brush coming in contact with a body to be charged, the contact means including, as a magnetic particle forming the magnetic brush, the magnetic particle containing at least a particle having a negative electronegativity, and voltage application means for negatively charging the body to be charged by applying a specified bias voltage through the magnetic brush in the contact means to the body to be charged.

Besides, according to another aspect of the invention, a charging method includes bringing a magnetic brush formed of a magnetic particle containing at least a particle having a negative electronegativity into contact with a body to be charged, and negatively charging the body to be charged by applying a specified bias voltage through the magnetic brush to the body to be charged.

DESCRIPTION OF THE DRAWINGS

FIG. 2 is a data table showing results of a comparison experiment performed using samples for comparison.

FIG. 3 is a data table showing results of the comparison experiment performed using samples for comparison.

FIG. 5 is a data table showing results of a comparison experiment performed using samples for comparison.

DESCRIPTION OF THE EMBODIMENTS

Hereinafter, embodiments of the invention will be described with reference to the drawings.

Figure 1:
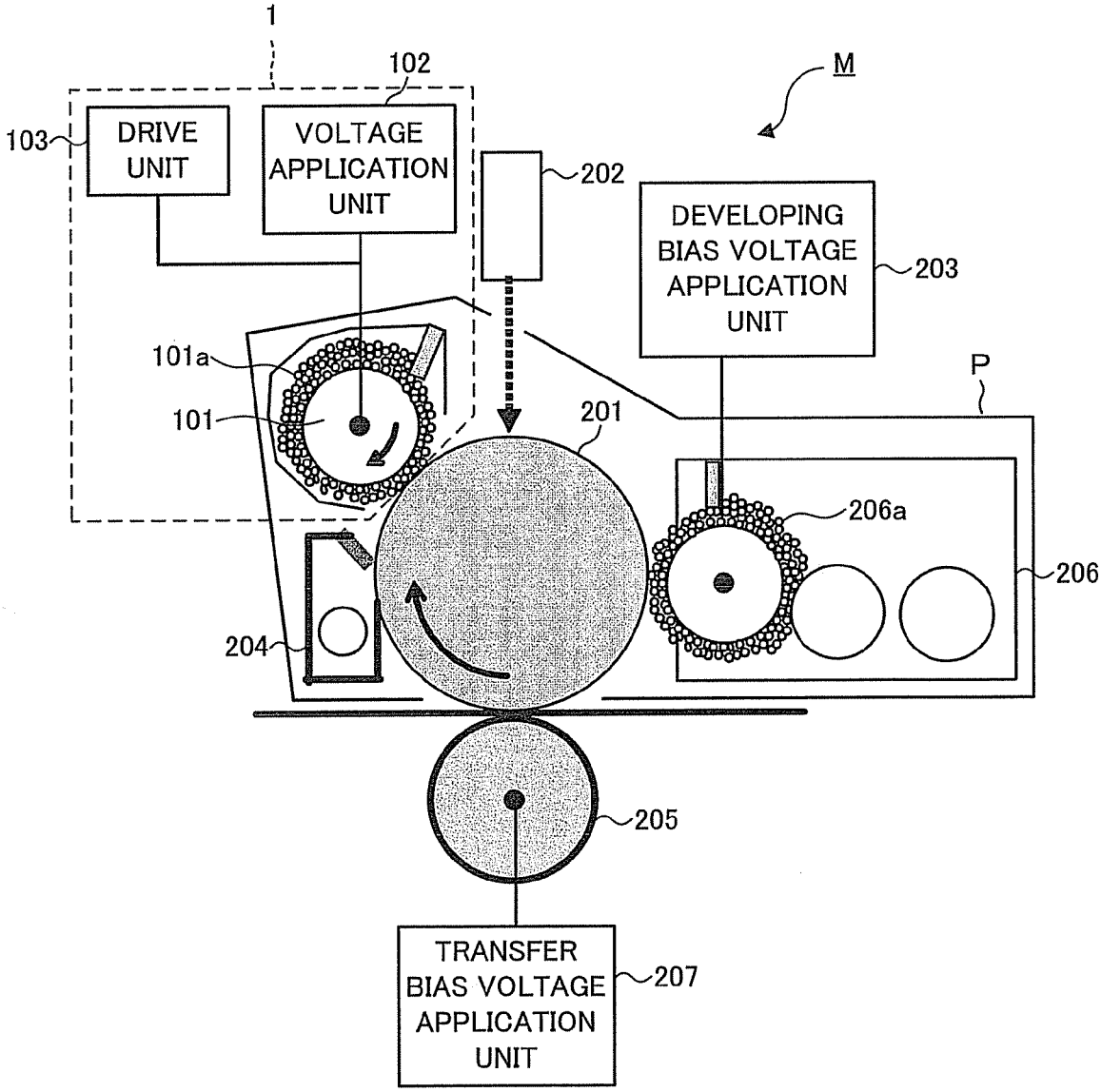
FIG. 1 is a schematic structural view for explaining a charging device 1 according to an embodiment and an image forming apparatus M including the same.

FIG. 1 is a schematic structural view for explaining a charging device 1 according to an embodiment and an image forming apparatus M (MFP: Multi Function Peripheral) including the same.

The image forming apparatus M according to the embodiment includes the charging device 1 to charge a photoconductor 201 as a body to be charged, the photoconductor (image bearing body) 201 having a role as the body to be charged that is charged by the charging device and bears an electrostatic latent image to be developed by a developer, an exposure unit 202 to form the electrostatic latent image by exposing a photoconductive surface of the photoconductor 201, a developing unit 206 to develop the electrostatic latent image formed on the photoconductor 201 by the developer, a developing bias voltage application unit 203 to apply a specified bias voltage between the developing unit 206 and the photoconductor 201, a cleaning unit 204 to clean the developer or the like remaining on the photoconductive surface of the photoconductor 201, a transfer unit 205 to transfer a developer image to a sheet by pressing the sheet to the photoconductive surface on which the developer image is formed, and a transfer bias voltage application unit 207 to apply a specified transfer bias voltage between the transfer unit 205 and the photoconductor 201.

A process unit P integrally supports the photoconductor and at least one of the charging device, the developing unit, the cleaning unit and the memory removal member, and is attachable to and detachable from the main body of the image forming apparatus. In this embodiment, as shown in FIG. 1, the process unit P includes the photoconductor 201, a contact unit 101, the developing unit 206, and the cleaning unit 204.

Next, the details of the charging device 1 according to this embodiment will be described. The charging device 1 of this embodiment includes the contact unit (contact means) 101, a voltage application unit (voltage application means) 102, and a drive unit (drive means) 103.

The contact unit 101 includes a magnetic brush 101*a* coming in contact with the photoconductor. The contact unit 101 includes a magnetic particle containing at least a particle having a negative electronegativity as the magnetic particle forming the magnetic brush 101*a*.

Specifically, the contact part 101 includes a nonmagnetic conductive sleeve, a magnet roll contained therein, and magnetic particles on the sleeve. The magnetic roll is fixed, and at a close position between the sleeve and the photoconductor 201, the sleeve surface rotates with a peripheral speed difference with respect to the photoconductive drum surface. The magnetic flux density of the surface of the sleeve at the closest position between the photoconductor 201 and the charging sleeve is 500 to 2,000 Gauss, the bead chains of the magnetic brush 101*a* are regulated by a magnetic blade opposite to the sleeve, and there occurs a state of the bead chains with a height of about 0.5 to 2 mm. In the longitudinal direction of the charging member, the attachment width of the magnetic particles of the magnetic brush 101*a* is 330 mm, the amount of magnetic particles of the magnetic brush 101*a* is about 17 g, a gap at a nip between the charging sleeve and the photoconductive drum is set to be narrow as compared with the height of the bead chains of the magnetic brush 101*a*, and the tip of the bead chains of the magnetic brush 101*a* comes in contact with the photoconductor surface.

The voltage application unit 102 applies a specified bias voltage to the photoconductor through the magnetic brush 101*a* in the contact unit, so that the photoconductor is negatively charged.

The drive unit 103 drives the sleeve of the contact unit so that a portion of the contact unit 101 coming in contact with the photoconductor 201 is moved relatively to the photoconductor 201.

Although the peripheral speed ratio of the sleeve and the photoconductor 201 varies according to the rotation direction, that is, a forward direction (so-called with direction) or a reverse direction (so-called against direction) with respect to the photoconductor, and in the forward direction, it is preferable that the speed is 1.3 times or more faster than that of the photoconductor surface, and in the reverse direction, it is preferable that the speed is in the range of from 0.2 times to 3 times faster. When the speed is too slow, uneven charging is liable to occur, and when the speed is too fast, the magnetic particle is liable to be attached to the photoconductor 201.

In this embodiment, the sleeve was rotated in the reverse direction, and the peripheral speed was made 1.5 times as faster than that of the photoconductor 201. The magnetic flux density was made about 1,000 Gauss, the height of the bead chains of the magnetic brush 101*a* was set to 1.2 mm, and the gap at the nip between the charging sleeve and the photoconductor 201 was set to 0.7 mm.

Next, the magnetic particles used in this embodiment will be described in detail.

As the magnetic particles forming the magnetic brush 101*a* in the contact unit 101, it is possible to use particles which have an average particle diameter of 10 to 100 μm, a saturation magnetization of 20 to 250 emu/cm$^3$, and a resistance (volume resistivity) of $10^2$ to $10^{10}$ Ωcm. When the existence of an insulation defect of the photoconductive drum, such as a pinhole, is considered, it is conceivable that about $10^6$ to $10^7$ Ωcm is most suitable (according to a conventional system, a resistance of $10^6$ Ωcm or more is preferable, and in order to improve the charging performance, it is appropriate that the resistance is as small as possible). In this embodiment, the magnetic particles having an average particle diameter of 30 μm, and a saturation magnetization of 200 emu/cm$^3$ were used, and an experiment was performed while the resistance of the magnetic particles was changed. The particle diameter of the magnetic particles was measured such that a laser diffraction/scattering particle size distribution measuring apparatus (LA-950 made by HORIBA, Ltd.) was used, the range of 0.1 to 200 μm was divided into 32 parts to perform measurement, and an average particle diameter of 50% in volume distribution was made the average particle diameter.

The resistance value of the particles was measured such that the magnetic particles of 1 g were filled in a tubular container with an area of about 100 mm$^2$, they were pressurized at 5 kg/cm$^2$, an voltage of 100 V was applied from above and below, and the resistance value was calculated from a current flowing therethrough.

For the measurement of the magnetic characteristics of the magnetic particles, a DC magnetization B-H characteristic automatic recording apparatus BHH-50 of Riken Denshi Co., Ltd. can be used. At that time, the magnetic particles are filled in a cylindrical container with an inner diameter of 6.5 mm and a height of 10 mm at a load of about 2 gf, the particles are made not to move in the container, and the saturation magnetization is measured from the B-H curve.

As the magnetic particle, there is used a resin magnetic particle which is formed by dispersing magnetite as a magnetic material into resin and dispersing carbon black for conduction and resistance adjustment, or a particle obtained by oxidizing and reducing the surface of a magnetite simple substance, such as ferrite and adjusting the resistance, or a particle obtained by coating the surface of a magnetite simple substance, such as ferrite, with resin and adjusting the resistance. In this embodiment, the latter in which the resistance was adjusted by the resin coating was used, and a diamond fine particle (corresponding to a particle having a negative electronegativity) was dispersed in this resin portion.

The resin coating to the magnetic particle was performed as follows.

<Experimental Condition 1 (Without a Diamond Fine Particle)>

A silicone resin of 100 parts was diluted to form a dispersion liquid with a solid content of 5 wt %, the dispersion liquid was applied onto the surface of the magnetic material particle at a rate of about 40 g/min by using a fluidized-bed coating apparatus in an atmosphere of 100° C., and further, heating was performed at 240° C. for 2 hours, and the resin coating film of a thickness of 0.55 μm was formed.

Besides, as the need arises, for the resistance adjustment, carbon black of 0.5 to 20 parts was added to the silicone resin to form the dispersion liquid.

| | Average diameter of magnetic particle | Resistance value |
|---|---|---|
| Sample 1 | 30.5 μm | $5 \times 10^4$ Ωcm |
| Sample 2 | 30.5 μm | $5 \times 10^5$ Ωcm |
| Sample 3 | 30.6 μm | $5 \times 10^6$ Ωcm |
| Sample 4 | 30.5 μm | $5 \times 10^7$ Ωcm |

<Experimental Condition 2 (With a Diamond Fine Particle)>

A mixture of silicone resin and a diamond fine particle was diluted to form a dispersion solution, and as the diamond fine particle, a cluster diamond with a nominal primary particle diameter of 3 to 10 nm was used. As the diamond fine particle, for example, one made by New Metals and Chemicals Corporation, Ltd. can be used. It is appropriate that the shape is spherical. Since the diamond particle is generally manufactured by an explosion, it has many impurities, and the particle diameter distribution becomes relatively broad. Then, a following refining process was performed.

First, as a hot concentrated sulfuric acid process, cleaning was performed at 250 to 350° C. by a mixture solution of concentrated nitric acid and concentrated sulfuric acid for 2 hours, and subsequently, as a dilute hydrochloric acid process, a cleaning process was performed at 150° C. for 1 hour. Thereafter, cleaning was performed in a room temperature state by fluorinated acid for 1 hour, and the impurities were eliminated. Next, in the state where the diamond particle refined as stated above was dispersed in pure water of 100 to 1,000 times, alcohol was added to form a colloidal solution, and then, while the condition of ultrasonic dispersion was changed, the dispersion was performed for 10 minutes to 5 hours. Further, a centrifugal separator was used to perform the dispersion at 3,000 to 20,000 G for 3 to 30 minutes, and the supernatant fluid was made the dispersion liquid of the diamond particle.

The cluster diameter of the diamond particle was measured using a dynamic optical scatter particle diameter distribution measuring apparatus (LB-550 made by HORIBA, Ltd.). The average particle diameter is an average particle diameter of 50% in volume distribution. Besides, with respect to a sample having a relatively large average particle diameter, similarly to the measurement of the particle diameter of the magnetic particle, the laser diffraction/scattering particle size distribution measuring apparatus (LA-950 made by HORIBA, Ltd.) was used, the range of 0.1 to 200 μm was divided into 32 parts to perform measurement, and an average particle diameter of 50% in volume distribution was made the average particle diameter.

| | Magnetic particle diameter | Diamond cluster average diameter | Resistance value |
|---|---|---|---|
| Sample 5 | 30.5 μm | 3 nm | $5 \times 10^6$ Ωcm |
| Sample 6 | 30.5 μm | 100 nm | $6 \times 10^6$ Ωcm |
| Sample 7 | 30.6 μm | 250 nm | $6 \times 10^6$ Ωcm |
| Sample 8 | 30.5 μm | 2 μm | $4 \times 10^6$ Ωcm |
| Sample 9 | 30.4 μm | 30 μm | $5 \times 10^6$ Ωcm |
| Sample 10 | 30.5 μm | 50 μm | $6 \times 10^6$ Ωcm |
| Sample 11 | 30.4 μm | 26 nm | $5 \times 10^5$ Ωcm |
| Sample 12 | 30.5 μm | 24 nm | $5 \times 10^4$ Ωcm |

<Experimental Condition 3 (Carbon Nanotube Dispersion)>

In the foregoing experimental condition, although the example has been described in which the diamond fine particle having the large negative electronegativity is applied, for example, even when a carbon nanotube, not the diamond fine particle, is used, a certain effect is obtained. Since the carbon nanotube has a very thin needle shape, the electric field is concentrated on the tip part and the field emission property is high. That is, the same effect as the diamond fine particle can be expected at the tip of the tube.

Then, in this experimental condition, a coat layer was provided under the same condition as the experimental condition 2 except that a mixture of a silicone resin and a carbon nanotube (corresponding to the particle having the negative electronegativity) was diluted to form a dispersion solution, and the magnetic particle was obtained.

The carbon nanotube was produced by an arc discharge method in which synthesis was performed by causing an arc discharge between two graphite rods in a noble gas, and had a diameter of 10 to 100 μmϕ and a length of 50 to 500 μm, the carbon nanotube of 1 part was dispersed in the silicone resin of 100 parts by using a ball mill, and the dispersion liquid was diluted to form a dispersion liquid with a solid content of 5 wt % and was applied.

| | Magnetic particle diameter | Resistance value |
|---|---|---|
| Sample 13 | 30.5 μm | $5 \times 10^6$ Ωcm |
| Sample 14 | 30.5 μm | $5 \times 10^5$ Ωcm |
| Sample 15 | 30.6 μm | $5 \times 10^4$ Ωcm |

A negatively charged organic photoconductor was used as the photoconductor.

In this embodiment, a comparison test was performed between a type in which a charge injection layer for conventional magnetic brush charging was provided in the photoconductor, and a type in which it was not provided.

The photoconductor has such a structure that on an aluminum drum with, for example, a diameter of 30 mm, from an aluminum base layer side in sequence, a first layer is an under coating layer, a second layer is a positive charge injection prevention layer, a third layer is a charge generation layer, and a fourth layer is a charge transport layer. Although this is a general function separation type organic photoconductor, the structure of the invention is not essentially limited, and a single layer type photoconductor of organic, ZnO, selenium, a-Si (amorphous silicon) or the like can also be used.

In the conventional injection charging, a charge injection layer is generally provided as a fifth layer. As the charge injection layer, for example, a layer obtained by dispersing $SnO_2$ ultra-fine particle into photo-curing acryl resin can be cited as an example, and specifically, there is disclosed a layer in which an $SnO_2$ particle doped with antimony to reduce resistance and having an average particle diameter of about 0.03 μm is dispersed at a ratio of 5:2 by weight ratio with respect to resin. Actually, the volume resistance value of the charge injection layer is changed by the amount of dispersion of conductive $SnO_2$, and in order to satisfy a condition in which an image flow is not caused, it is desirable that the resistance value of the charge injection layer is $1\times10^8$ Ωcm to $10^{15}$ Ωcm, and as the photoconductor of the comparison example in this embodiment, the volume resistance value of the charge injection layer was made $1\times10^{12}$ Ωcm. With respect to the resistance value of the charge injection layer, the charge injection layer was applied on an insulating sheet, and this was measured at an applied voltage of 100V by HAIRESUTA made by Mitsubishi Petrochemical Co., Ltd.

The coating solution prepared in this way was coated to have a thickness of about 3 μm by a suitable coating method such as a dipping coating method so that the charge injection layer was formed, and as a photoconductor of a comparison example, a photoconductor A: an organic photoconductor up to the fourth layer without a charge injection layer, and a photoconductor B: an organic photoconductor in which the foregoing charge injection layer was provided on the photoconductor A were used.

The samples as stated above were used, and a DC bias of −500 V was applied to a sleeve of a magnetic brush charging device by constant voltage control. Besides, in magnetic brush charging, since an AC bias is generally often superimposed in order to stabilize the charging characteristics, also with respect to a case where a rectangular wave AC voltage of 1,000 Hz and 700 Vpp (peak-to-peak voltage) was superimposed on the DC bias and was applied, a comparison was made under conditions as follows:

a bias C: DC-500 v was applied by constant voltage control, and a bias D: a rectangular wave AC voltage of 1,000 Hz and 700 Vpp was superimposed on DC-500 v and was applied.

FIG. 2 and FIG. 3 show a data table showing the results of a comparison experiment performed using the samples for comparison produced as described above. FIG. 2 shows the former half of the data table, and FIG. 3 shows the latter half of the data table.

In the experiment, a continuous printing test was performed in the image forming apparatus having the structure as shown in FIG. 1. The method was such that three kinds (image density: about 0.3, 0.5, 0.8) of halftone images in which the screen line number by a multilevel screen of 600 dpi was 212 lines, a whole white background image, and a whole black (solid) background image were printed on the whole surface of an A3 size sheet, and it was visually checked whether there occurred an image streak due to uneven charging, an image defect due to a pinhole of the photoconductor, and an attachment of the magnetic particle from the magnetic brush charging device to the photoconductor.

As a procedure, after an image is checked in the initial state of the charging device, in a state where paper is not fed, an operation in which a character chart of a printing ratio of 4% is developed on the photoconductor and collection is performed by a photoconductive cleaner is performed a number of times equivalent to 10,000 sheets of A4 size paper, and then, paper is fed, and the image check as stated above is performed. With respect to a combination in which a disadvantage did not occur on an image, the test was repeated, and the test corresponding to 70,000 sheets in total was performed. Test results are shown in FIG. 2 and FIG. 3.

In the drawing, a case where a streak due to uneven charging occurs is denoted by "a", and a case of an image defect due to a pinhole generated by a leak in the photoconductor is denoted by "b". Besides, a case of a defect on an image due to the attachment of a magnetic particle of a charging unit to a photoconductor and onto a sheet of paper (since a trouble occurs in the exposure unit, a trace is seen on the image, or the magnetic particle is attached onto the sheet of paper) is denoted by "attachment". Especially with respect to "a", the occurrence state was visually divided into levels of 1 to 3 stages and was evaluated. Here, "level 1" is a level at which it is actually hardly noticeable, and the test was continued, however, "level 2" indicates the so-called image defect, and is the level at which the user makes a judgment of NG because of the life or the like, and the test was discontinued at that stage. The "level 3" indicates a case where a halftone image itself is not normally formed, and in a case where a difference (ΔID) between the maximum value and the minimum value of the reflection density on an image in which a local defect, such as a pinhole or an exposure damage, was removed was 0.4 or more, the case was made the level 3. In the table, they are respectively denoted by "a1", "a2" or "a3". Besides, with respect to "b" and "attachment", when it occurred at a level in which it can be visually sufficiently recognized even if only slightly, a judgment of NG was made, and the test was discontinued there.

In samples 1 to 4 of the experimental condition 1 of FIG. 2, a conventional magnetic particle is used and the resistance of the magnetic particle is changed.

First, in the sample 3 of the resistance of $5\times10^6$ Ωcm, when the photoconductor was of the B type (without a charge injection layer), uneven charging occurred from the beginning, and a normal image could not be obtained ("a3"). Besides, even if the photoconductor was changed to the A type, uneven charging occurred also from the beginning at the bias C (only DC), and this case was the "a2" level.

When the photoconductor was changed to the A type (with a charge injection layer), and the bias was changed to the bias D (with AC superposition), although "a1" occurred after 50,000 sheets, the state was kept even after 70,000 sheets. In the sample 4 in which the resistance value was made larger than that of the sample 3 by one digit, as compared with the sample 3, streaks occurred slightly early, and 70,000 sheets were not attained. In the samples 1 and 2 with low resistance, a photoconductor pinhole occurred halfway in both, and NG occurred.

In a magnetic particle in a conventional charging device, it is inevitable that the photoconductor includes the charge injection layer, and AC is superimposed on the charging bias, and further, unless the resistance of the magnetic particle is optimized, the life is further shortened by the leak or the like.

On the other hand, in the sample 5 of this embodiment, the diamond particle is dispersed, and an adjustment is made to the optimum resistance value in the conventional magnetic particle, and first, when the photoconductor is of the B type (without a charge injection layer), and further, even at the setting of the bias C (DC), the level is "a1" in the initial state, and as compared with the conventional example, the performance is remarkably improved. Besides, in samples 6-10, the diamond fine particle is dispersed similarly to the sample 5, and the dispersion condition is changed, and resultantly, the dispersed cluster diameter is changed.

From these, it is found that there is a tendency that the durability is slightly excellent when the cluster diameter of the diamond particle diameter is small. When the photoconductor was of the B type (without a charge injection layer), and even at the setting of the bias C (DC), in the sample 5 with a small particle diameter, the "a1" level was kept even after 70,000 sheets, however, in the sample 10 with a large cluster diameter, the level was "a2" from the beginning.

From just this result, it is understood that it is better when at least the cluster diameter of the diamond fine particle is small, and when the photoconductor without the charge injection layer is charged by only the DC bias, it is necessary that the cluster diameter is 30 μm or less, and desirably, 2 μm or less. From this result, it is understood that it is preferable that the diamond particle used in this embodiment has an average particle diameter in the range of 3 nm to 30 μm.

However, also in the sample 10, when the bias is changed to the bias D (with AC superposition), the initial state is improved to the "a1" level, and at the same time, also in other samples 5 to 9, there is a tendency that the streak level is improved. This indicates that although only the DC bias can be used, when the AC as in the conventional magnetic brush charging device is superimposed, the charging performance is further stabilized, that is, when this embodiment is applied, the charge injection layer of the photoconductor, which is inevitable in the conventional injection charging, can also be eliminated. Besides, even if the photoconductor A (with a charge injection layer) like a conventional one is selected, a defect such as a streak does not naturally occur after 70,000 sheets, and it is understood that as compared with the conventional charging device, the performance is improved in all combinations.

Subsequently, samples 11 and 12 are such that the resistance is changed in the magnetic particle of this embodiment.

Similarly to the experimental condition 1, when a test was performed under the condition of the photoconductor A (with a charge injection layer) and the bias D (AC superposition), in the conventional magnetic particle, a photoconductor pinhole occurred in the sample of the resistance of $5\times10^5$ Ωcm, whereas in the sample 11 of this embodiment, a pinhole did not occur.

When the bias condition was changed to only DC, also in the sample 12, the photoconductor pinhole did not occur, and 70,000 sheets was attained. This is because although the charging stability is improved by superimposing the AC, an electric field stress to the photoconductor is increased. It is apparent that the embodiment in which the injection charging is possible only by the DC application is advantageous also in that point. Besides, even if the same AC bias is superimposed, as compared with the conventional example, in this embodiment, the photoconductor is hardly damaged and the pinhole does not occur, and it appears that this is because breakdown due to local electric field concentration hardly occurs since the diamond fine particle has a small diameter as compared with normal carbon black and has good dispersion property.

<Experimental Condition 4 (Carbon Nanotube Dispersion)>

In samples 13 to 15, a carbon nanotube, not the diamond fine particle, is dispersed in the magnetic particle, and the resistance of the magnetic particle is changed.

The resistance is $5\times10^6$ Ωcm, and when a test was performed in the optimum area also in the conventional example, in the combination (Experiment No. 40) of the photoconductor B (without a charge injection layer) and the bias D (AC superposition), the level is "a1" at the beginning, and it is understood that although the effect is inferior as compared with the diamond fine particle (Experiment No. 24), an improvement is made as compared with the conventional example (Experiment No. 7).

Besides, in sample 14, the resistance of the magnetic particle is lowered, and when a test was performed under the condition of the photoconductor A (with a charge injection layer) and the bias D (AC superposition) similarly to the experimental condition 1, in the conventional magnetic particle, a photoconductor pinhole occurred in the sample of a resistance of $5\times10^5$ Ωcm (experiment No. 3), whereas a pinhole did not occur in the sample 14 (experiment No. 42) of this embodiment. It appears that this is because although the carbon nanotube is needle-shaped and the electric field is liable to be concentrated, since the tip has a very minute size, it hardly damages the photoconductor similarly to the diamond fine particle.

As stated above, in the magnetic brush charging device using the magnetic particle according to this embodiment, it is found that as compared with a conventional one, the charging efficiency is remarkably improved. As other effects, especially in the case where a cleanerless process is used, the photoconductor is stably polished, and it is possible to expect an effect to prevent a fixing phenomenon of toner or an external additive to the surface of the photoconductor. Next, a verification experiment for this will be described.

Figure 4:
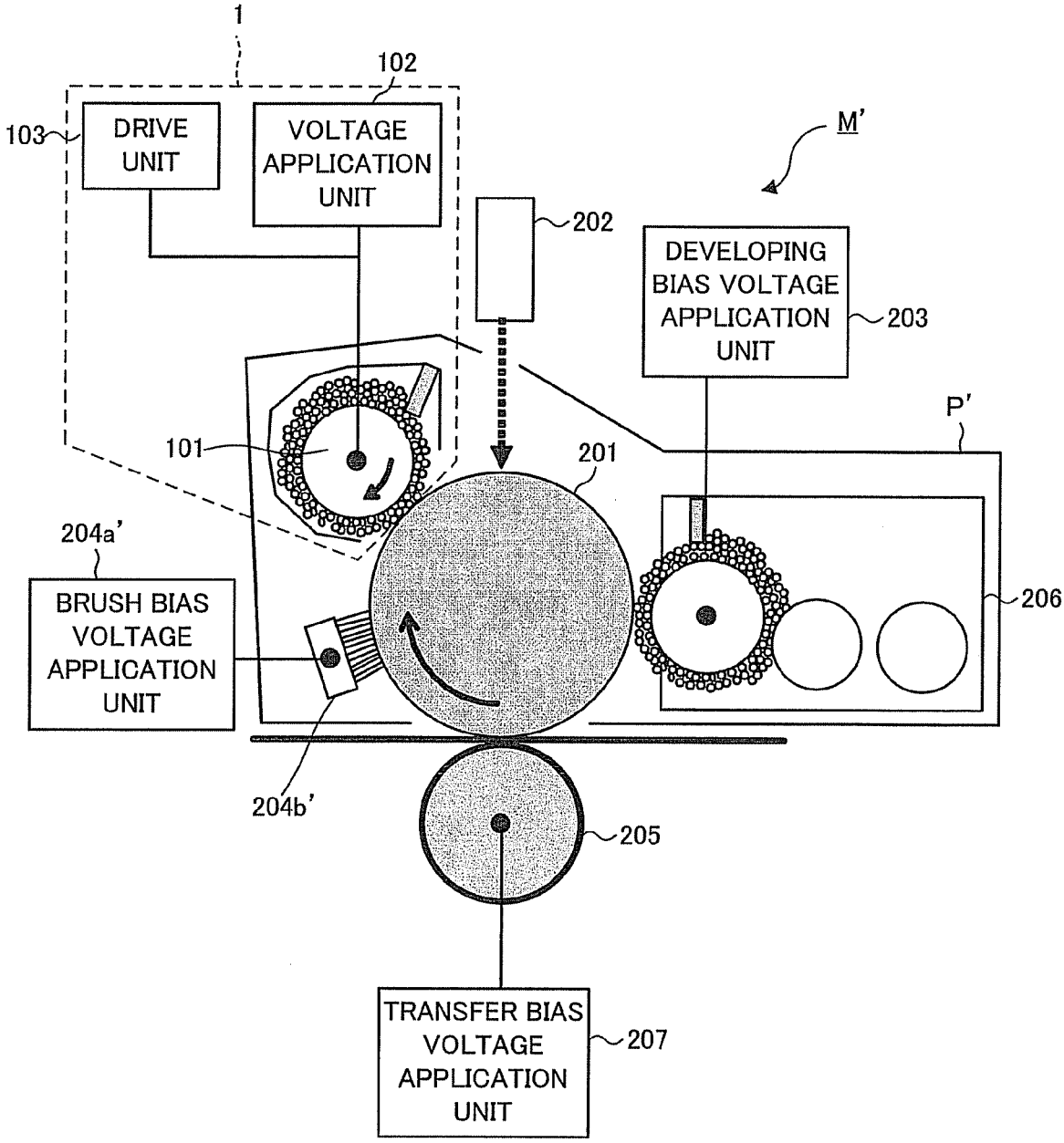
FIG. 4 is a view for explaining an image forming apparatus having a structure different from the structure shown in FIG. 1.

In the experiment, an image forming apparatus having a process structure as shown in FIG. 4 was used. A dedicated photoconductor cleaner is eliminated, and at that position, a fixed type brush 204*b*' to which DC+300 v is applied by a brush bias voltage application unit 204*a* is arranged. This brush 204*b*' is for unifying the charging polarity of residual transfer toner, which has not been transferred in the transfer unit and has remained on the photoconductor, in the plus direction (memory removal member). As shown in FIG. 4, a process unit P' includes a photoconductor 201, a contact unit 101, a developing unit 206 and the brush 204*b*'.

The fiber length of the brush is 4 mm, the thickness is 4 decitex, and nylon is used. The resistance is $1\times10^4$ to $10^7$ Ωcm, and this is a value measured from a current value obtained when 300 v is applied in a state where the brush 204*b*' is pressed to a metal plate at a load of 500 g.

In the apparatus structure as stated above, the residual transfer toner is positively charged by the brush and is collected by a charging device 1. The toner taken in the magnetic brush charging unit receives an electric charge in the minus direction from the magnetic particle, and is negatively charged, and is gradually discharged onto the photoconductor. At that time, the pattern of the residual transfer toner completely disappears, and it is eliminated that a memory image or the like is formed at the image formation of a next step, and a bad influence is exerted. The discharged toner is collected at the developing unit 206, and in a non-image part, it is collected in the developing machine, and an image part remains on the photoconductor as a development image.

In the cleanerless process as stated above, when a large amount of toner enters the magnetic brush charging device, the charging performance is lowered, and therefore, it is important that the taken toner is quickly negatively charged and is uniformly returned to the photoconductor. Besides, since there is no cleaner blade and there is no member to shave the photoconductor, as stated above, there is a problem that so-called photoconductor filming is liable to occur in which toner or separated external additive is fixed to the photoconductor.

The evaluation was performed in the same method as the former test, however, the test was performed without using paper in the case of a structure where a dedicated cleaner is provided, whereas in this experimental condition, since a dedicated cleaner was not provided, paper was used and the paper feed test was actually performed.

With respect to evaluation items, in addition to "a", "b" and "attachment", "c" of an image defect due to filming was added. This is such that a halftone, a white background, or a solid image similar to that of the former test is printed, and when a streak or a white point is generated, the surface of the photoconductor is visually checked, and in the case where an attachment is recognized at a position corresponding to an image, the evaluation of filming "c" is made. Also in this case, a level which is allowable although a streak or a white point is recognized is made "c1", and an NG level is made "c2".

Besides, the amount of film shaving of the photoconductor was also measured. The amount of film shaving was measured by an eddy current type film thickness meter made by KETTO DENSHI. Measurement was performed 30 times while an arbitrary position was changed, an average value for 20 times from the center was made the film thickness, and the amount of shaving from the photoconductor of the initial state was measured.

These results are shown in FIG. 5. In the magnetic brush charging device using the magnetic particle of the sample 3 of the conventional example, even in the combination of the photoconductor A (with a charge injection layer) and the bias D (AC superposition), after approximately 10,000 sheets, the "a1" level occurred due to the pollution of the magnetic brush charging device, and at the same time, the filming was generated and the "c1" level occurred, and after 20,000 sheets, the levels of both became 2 and NG occurred.

On the other hand, in the case where the magnetic particle of the sample 5 was used, in the combination of the photoconductor A (with a charge injection layer) and the bias D (AC superposition), after printing of 50,000 sheets, although a streak due to the pollution of the charging device did not occur, uneven halftone due to the filming of "c1" level slightly occurred. It appears that the reason why the streak due to the pollution did not occur is that since the magnetic particle of the embodiment is excellent in the injection charging characteristic, the residual transfer toner taken in the charging device can be efficiently and uniformly discharged to the photoconductor side. Besides, it appears that because of the effect of the stable polishing action peculiar to the magnetic particle in this embodiment, the filming level is improved as compared with the conventional example.

Besides, here, in the combination of the photoconductor A (with a charge injection layer) and the bias C (DC), after printing of 50,000 sheets, although a streak due to the pollution of the charging device came to have the "a1" level, the filming did not occur. When AC is superimposed on the charging device, although the margin of charging performance is certainly improved, it appears to be disadvantageous for the filming.

Also with respect to the amount of shaving of the photoconductor, as compared with the case where the blade cleaner is used (experiment No. 17, lowermost stage in the table), it is about half value. As stated above, by applying this embodiment, also in the case where the cleanerless process is used, the charging device is hardly polluted, and the photoconductor filming can also be prevented.

The effect as stated above becomes remarkable especially in the case where a material is used in which the photoconductor surface is hardly shaven. As the photoconductor with high durability, in the case where an inorganic photoconductor containing a-Si as its main ingredient, or an organic photoconductor containing a hole transport material having a chain polymerization functional group is used, the photoconductor has high surface hardness and is hardly get scratched, and elongation of the life of the photoconductor is achieved. When the photoconductor as stated above is used, and when the magnetic brush charging device is used, the photoconductor itself is hardly shaven, the fixed toner component is stably removed from the photoconductor, and the photoconductor filming can be prevented. Test results of the case where the respective photoconductors are used are shown in experiment Nos. 65 and 66 of FIG. 5. Since the charge injection layer was not provided, a slight streak occurred from the initial state, however, a test of 50,000 sheets was cleared in a state where the photoconductor was hardly shaven.

Besides, in the conventional magnetic brush charging device, especially in the conventional magnetic brush charging device, since the a-Si photoconductor has a thin film thickness and has defects such as a scratch, dielectric breakdown is liable to occur, and it has not been capable of being actually used. However, in the magnetic brush charging device according to the embodiment, it is confirmed that a pinhole of the photoconductor hardly occurs, and it is needless to say that the device is advantageous for such a thin photoconductor. Since the thin photoconductor is advantageous in high resolution also in an organic photoconductor of a function separation type, how to use it is a very important problem in recent years.

Figure 6:
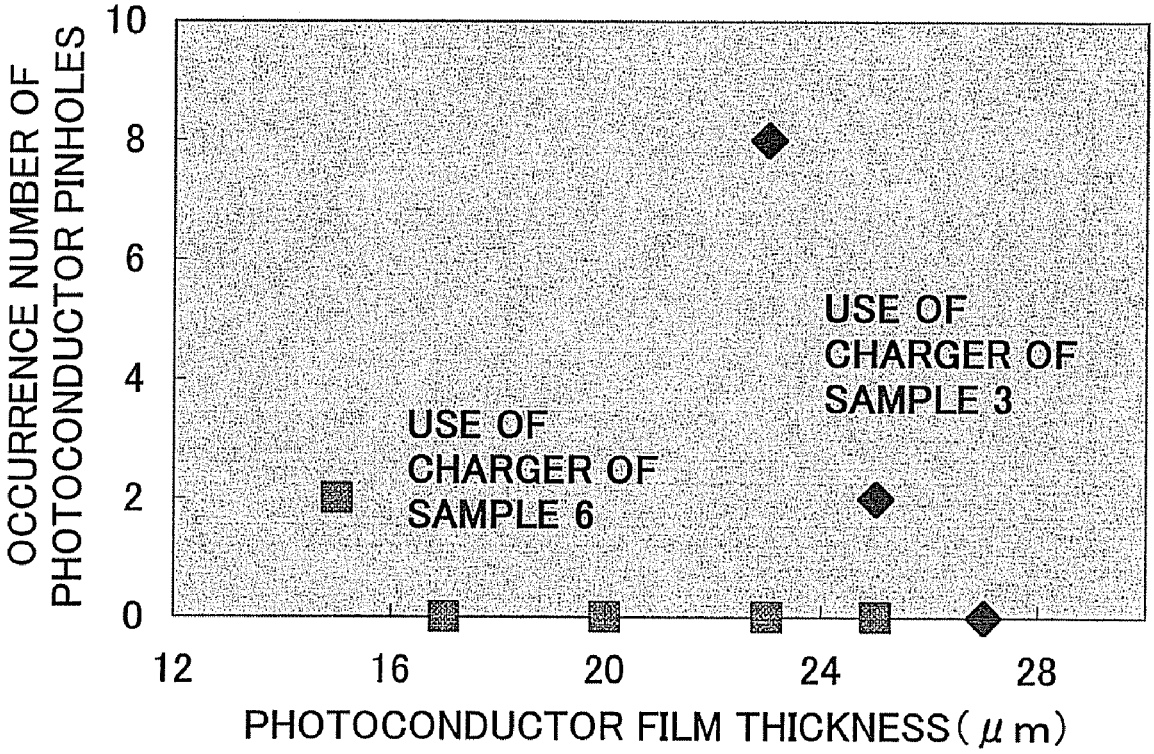
FIG. 6 is a view showing results of comparison of occurrence states of photoconductor pinholes in the case where the film thickness of the photoconductor is changed.

FIG. 6 shows comparison results of occurrence states of photoconductor pinholes in the case where the thickness of the photoconductor is changed. The photoconductor A (with a charge injection layer) was used, the thickness of a charge transport layer was changed to adjust the whole film thickness, and the bias D (AC superposition) was set. When the number of pinholes due to a leak on the photoconductor after printing of 10,000 sheets was counted, in the sample 3 of the magnetic particle of the conventional example, a pinhole occurred when the film thickness was about 25 μm or less, however, in the sample 6 of this embodiment, a pinhole did not occur even in the thickness of 17 μm.

As stated above, this embodiment is very effective in efficiently using a photoconductor with a thin layer (for example, an organic photoconductor of 25 microns or less).

Besides, the magnetic particle (magnetic particle forming the magnetic brush in the contact unit) used in the magnetic brush charging device and a magnetic particle (magnetic carrier particle contained in a developer to develop an electrostatic latent image born by the photoconductor 201) 206*a* used in the developing unit 206 may have the same structure. By adopting the structure as stated above, even if the magnetic particle is attached to the photoconductor side from the magnetic brush charging device, it is collected in the developing unit 206 and can be used as the carrier in the developing unit 206.

Besides, as described above, when the magnetic particle containing the particle having the high negative electronegativity, such as the diamond particle, is mixed into the magnetic particle forming the magnetic brush, as compared with the conventional magnetic particle (not containing the diamond particle or carbon nanotube), the charging efficiency is remarkably improved, the charge injection into the body to be charged, which is caused by the bias voltage applied by the voltage application unit, is liable to occur, and there is an effect that the body to be charged can be efficiently negatively charged.

Besides, as the particle having the negative electronegativity, by adopting a particle having a hardness of a specified value or higher, such as the diamond particle or the carbon nanotube, when the particle having the negative electronegativity is made to have, for example, a higher hardness (hardness of the specified value or higher) than the hardness of an attachment formed by the filming on the surface of an image bearing body, at the time when the magnetic brush in the charging device is brought into contact with the surface of the image bearing body and is charged, the attachment due to the filming can be effectively removed. Besides, by using the particle having a rather high hardness, the degradation of the charging performance due to the abrasion of the particle can be suppressed.

When the magnetic brush charging device according to this embodiment is used, the stable charging of the photoconductor with a low applied voltage becomes possible. Especially, even if the surface layer with a low resistance for injection charging is not provided on the photoconductor side, the stable charging process becomes possible, which can contribute, as the device, to the improvement in picture quality. In addition, the reversely charged toner mixed in the charging device can be quickly discharged, and the durability as the charging device is also improved. Besides, by the polishing action to the surface of the photoconductor, it is possible to prevent the filming phenomenon in which a wax component in the toner or a separated external additive is fixed to the surface of the photoconductor, and it is effective when used especially for the cleanerless process.

Besides, as the prior art, there is known a technique using diamond-like carbon to raise the charging efficiency (for example, see JP-A-2002-351195), since the proximate charging is used in the technique, it is necessary that the diamond-like carbon is uniformly opposite to the photoconductor, and accordingly, it becomes necessary to use a production method such as a high cost CVD method.

On the other hand, in the charging device of this embodiment, it is not necessary that the diamond fine particle is uniformly exposed on the whole surface of the particle. This is because in the magnetic brush charging, a comparatively wide charging nip width can be ensured, and when it once comes in contact with the diamond fine particle in the nip, charging is possible. A high cost production method as in the prior art is not required, and it can contribute to the reduction in manufacture cost.

Besides, in this embodiment, since charge injection performance to wastes is greatly improved, even if a charging bias is not frequently changed, the polarity of the toner, paper powder, external additive or the like is inverted by charge injection and becomes liable to be discharged onto the photoconductor, and the lowering of the charging performance can be prevented. Especially, in recent years, from requests for miniaturization of a device and reduction of discharged toner, a device of a cleanerless process is increased in which a dedicated cleaning blade is not provided for a photoconductor, and transfer residual toner is collected by a developing unit and is reused. In the case of the cleanerless process as stated above, since the amount of residual transfer toner mixed into the charging device is remarkably increased, the above effect is further important.

Besides, according to this embodiment, since the diamond fine particle comes in contact with the photoconductor, the polishing effect of the surface of the photoconductor is also obtained. Especially, in the case of the cleanerless process, although the photoconductor is not shaven by the blade cleaner, the so-called filming phenomenon occurs in which wax in the developer or a separated external additive is attached and fixed to the surface of the photoconductor, and a disadvantage such as a streak occurs on the image, and in many cases, when the cleaner blade is not provided, the life of the photoconductor becomes short. In such a case, in the charging device of this embodiment, since the diamond fine particle polishes the surface of the photoconductor and gradually shaves the fixed filming, the filming of the photoconductor can also be prevented.

Although the invention has been described in detail using the specific embodiments, it would be apparent for those of ordinary skill in the art that various modifications and improvements can be made without departing from the sprit and scope of the invention.

As described above in detail, according to the invention, it is possible to provide the charging technique in which the generation of ozone is suppressed, and the charging efficiency can be improved.

What is claimed is:

1. A charging device comprising:

a contact unit configured to include a magnetic brush coming in contact with a body to be charged, the contact unit including, magnetic particles forming the magnetic brush, and at least a particle with a negative electronegativity being added to the magnetic particles, the particle with the negative electronegativity being a diamond particle, at least one of the diamond particles being positioned on a surface of the contact unit that comes into contact with the body to be charged; and a voltage application unit configured to negatively charge the body to be charged by applying a specified bias voltage through the magnetic brush in the contact unit to the body to be charged.

2. The charging device according to claim 1, wherein the particle having the negative electronegativity is a particle having a hardness of a specified value or higher.

3. The charging device according to claim 1, wherein the diamond particle has an average particle diameter in a range of 3 nm to 30 μm.

4. The charging device according to claim 1, wherein the body to be charged is an image bearing body to bear an electrostatic latent image to be developed with a developer.

5. The charging device according to claim 4, wherein the magnetic particle forming the magnetic brush in the contact unit is equal to a magnetic carrier particle contained in the developer to develop the electrostatic latent image born on the image bearing body.

6. An image forming apparatus comprising:

a charging device according to claim 1; and a photoconductor, as a body to be charged, to bear an electrostatic latent image to be developed by a developer.

7. The image forming apparatus according to claim 6, wherein the photoconductor is an organic photoconductor in which a thickness of a photoconductive layer is 25 microns or less.

8. The image forming apparatus according to claim 7, wherein the photoconductor includes a hole transport material having a chain polymerization functional group.

9. The image forming apparatus according to claim 7, wherein the photoconductor is a photoconductor comprising amorphous silicon.

10. The image forming apparatus according to claim 6, wherein the contact unit and the photoconductor are integrally supported as a process unit, and are attachable to and detachable from the image forming apparatus.

11. The image forming apparatus according to claim 6, further comprising a developing unit configured to supply the developer to the electrostatic latent image formed on the photoconductor and to collect a developer remaining on the photoconductor.

12. A charging device comprising:

contact means for including a magnetic brush coming in contact with a body to be charged, the contact means including, magnetic particles forming the magnetic brush, and at least a particle with a negative electronegativity being added to the magnetic particles, the particle with the negative electronegativity being a diamond particle, at least one of the diamond particles being positioned on a surface of the contact means that comes into contact with the body to be charged; and voltage application means for negatively charging the body to be charged by applying a specified bias voltage through the magnetic brush in the contact means to the body to be charged.

13. The charging device according to claim 12, wherein the particle having the negative electronegativity is a particle having a hardness of a specified value or higher.

14. The charging device according to claim 12, wherein the diamond particle has an average particle diameter in a range of 3 nm to 30 μm.

15. The charging device according to claim 12, wherein the body to be charged is an image bearing body to bear an electrostatic latent image to be developed by a developer, and the magnetic particle forming the magnetic brush in the contact means is equal to a magnetic carrier particle contained in the developer to develop the electrostatic latent image born on the image bearing body.

16. A charging method comprising:

bringing a magnetic brush into contact with a body to be charged, the magnetic brush including magnetic particles and a particle with a negative electronegativity, the particle with the negative electronegativity being a diamond particle, at least one of the diamond particles being positioned on a surface of the magnetic brush that comes into contact with the body to be charged; and negatively charging the body to be charged by applying a specified bias voltage through the magnetic brush to the body to be charged.

* * * * *